US009190228B2

(12) United States Patent
Bloeink et al.

(10) Patent No.: US 9,190,228 B2
(45) Date of Patent: Nov. 17, 2015

(54) OPERATING ELEMENT THAT CAN BE ACTUATED BY PRESSURE AND ROTATION

(71) Applicant: Leopold Kostal GmbH & Co. KG, Luedenscheid (DE)

(72) Inventors: Sabrina Bloeink, Luedenscheid (DE); Udo Renisch, Wipperfuerth (DE)

(73) Assignee: Leopold Kostal GmbH & Co. KG, Luedenscheid (DE)

( * ) Notice: Subject to any disclaimer, the term of this patent is extended or adjusted under 35 U.S.C. 154(b) by 218 days.

(21) Appl. No.: 14/029,973

(22) Filed: Sep. 18, 2013

(65) Prior Publication Data

US 2014/0034461 A1 Feb. 6, 2014

Related U.S. Application Data

(63) Continuation-in-part of application No. PCT/EP2012/060609, filed on Jun. 5, 2012.

(30) Foreign Application Priority Data

Jun. 8, 2011 (DE) ..... 10 2011 103 670

(51) Int. Cl.
*H01H 9/00* (2006.01)
*H01H 19/00* (2006.01)
(Continued)

(52) U.S. Cl.
CPC ..... *H01H 19/001* (2013.01); *G05G 1/08* (2013.01); *G05G 5/06* (2013.01); *G05G 5/08* (2013.01); *H01H 25/008* (2013.01)

(58) Field of Classification Search
CPC ... H01H 19/001; H01H 19/003; H01H 19/60; H01H 25/008; H01H 2221/01; G05G 5/08; G05G 5/06; G05G 1/08
USPC ..... 200/61.54, 564, 565, 572, 336, 4, 567, 200/568, 14
See application file for complete search history.

(56) References Cited

U.S. PATENT DOCUMENTS 6,218,635 B1 4/2001 Shigemoto et al.
6,344,643 B1 * 2/2002 Chen ..... 250/221
(Continued)

FOREIGN PATENT DOCUMENTS

DE 19715360 A1 10/1998
EP 1028446 A2 8/2000
(Continued)

OTHER PUBLICATIONS

European Patent Office, International Search Report for International Application No. PCT/EP2012/060609 mailed Oct. 2, 2012.
(Continued)

*Primary Examiner* — Renee Luebke
*Assistant Examiner* — Lheiren Mae A Caroc
(74) *Attorney, Agent, or Firm* — Brooks Kushman P.C.

(57) ABSTRACT

An operating element that can be actuated by pressure and rotation, comprising an actuating rotatably mounted on a bearing block by a bearing shaft, at least one switch that can be actuated by a pressure actuation of the actuator, a sensor for detecting a rotational actuation of the actuator, a detent wheel connected to the bearing shaft, and a spring-loaded detent element which interacts with a detent contour of the detent wheel and which blocks the rotational mobility of the detent wheel upon a pressure actuation of the actuator. The detent element is a lever which can pivot about a pivot bearing and which has a detent pin that sits against the detent contour. A pressure actuation of the actuator brings a portion of the lever closer to an object thereby limiting the pivoting range of the lever.

18 Claims, 3 Drawing Sheets

(51) Int. Cl.

| | |
|---|---|
| ***H01H 25/00*** | (2006.01) |
| ***G05G 1/08*** | (2006.01) |
| ***G05G 5/06*** | (2006.01) |
| ***G05G 5/08*** | (2006.01) |

(56) References Cited

U.S. PATENT DOCUMENTS

| | | | | |
|---|---|---|---|---|
| 6,388,212 | B1 | 5/2002 | Ishihara et al. | |
| 7,439,459 | B2 * | 10/2008 | Hyun et al. | 200/5 R |
| 7,668,327 | B2 | 2/2010 | Sluppke | |
| 2014/0374225 | A1 * | 12/2014 | Ficek | 200/61.54 |

FOREIGN PATENT DOCUMENTS

| | | | |
|---|---|---|---|
| EP | 1085546 | A2 | 3/2001 |
| EP | 1094483 | A2 | 4/2001 |
| EP | 1657959 | A2 | 5/2006 |

OTHER PUBLICATIONS

The International Bureau of WIPO, International Preliminary Report on Patentability for the corresponding International Application No. PCT/EP2012/060609, mailed Dec. 27, 2013.

* cited by examiner

OPERATING ELEMENT THAT CAN BE ACTUATED BY PRESSURE AND ROTATION

CROSS-REFERENCE TO RELATED APPLICATIONS

This application is a continuation-in-part of International Application No. PCT/EP2012/060609, published in German, with an International filing date of Jun. 5, 2012, which claims priority to DE 10 2011 103 670.2, filed Jun. 8, 2011; the disclosures of which are hereby incorporated in their entirety by reference herein.

TECHNICAL FIELD

The present invention relates to an operating element that can be actuated by pressure and rotation, the operating element including an actuator connected to a bearing shaft rotatably mounted on a bearing block, a switch that actuates upon a pressure actuation of the actuator, a sensor that detects rotational actuation of the actuator, a detent wheel connected to the bearing shaft, and a spring-loaded detent element that interacts with a detent contour of the detent wheel and blocks rotational mobility of the detent wheel during a pressure actuation of the actuator.

BACKGROUND

DE 197 15 360 A1 describes an operating device including an actuator formed as a knurled roller rotatably mounted on a bearing block. The bearing block and a printed circuit board (PCB) clipped thereto are immovably connected to one another. The actuator is rigidly arranged with respect to motions perpendicular to its axis of rotation with respect to the bearing block and a substrate. A switch arranged on the substrate is supported against a separate housing such that a pressure actuation of the actuator is transmittable to the switch. The mounted assembly made up of the actuator, the bearing block, and the PCB is movably supported with respect to the housing.

The operating device further includes a detent wheel and a spring-loaded detent. The detent wheel is connected with the actuator and includes recesses into which the detent penetrates. In the absence of pressure actuation, the rotational motion of the detent wheel is not affected by the actuator.

For many applications it is desirable that a rotationally actuated operating element have perceptible detent levels. A detent wheel with an undulating detent contour is provided for this purpose against which a spring-loaded detent pin presses.

A rotational actuation of the operating element with detent steps does not follow from DE 197 15 360 A1 since the detent that penetrates into the openings of the detent wheel here allows only a blockage or release of the actuator. Additional means would thus be required to achieve interrupted rotation of the operating element. Such additional means would require additional cost expenditures and a larger installation space.

SUMMARY

An object of the present invention includes an operating element that can be actuated by pressure and rotation, can implement both interrupted rotation and blocking of the rotational motion with pressure actuation, and is characterized by space savings and low cost construction.

In carrying out at least one of the above and other objects, the present invention provides an operating element including an actuator, a detent wheel, and a spring-loaded detent wheel. The actuator is rotatably mounted on a displaceable bearing block by a bearing shaft such that the actuator can be rotationally actuated and pressure actuated. The detent wheel is connected to the bearing shaft. The detent wheel has a detent contour. The spring-loaded detent element has a lever with a detent pin. The lever is pivotable at one end about a rotational bearing on the bearing block. The detent pin is biased by a spring against the detent contour of the detent wheel. The actuator including the bearing shaft with the detent wheel displace during a pressure actuation of the actuator such that the lever displaces to a fixed position in which the detent pin is pressed against the detent contour of the detent wheel with sufficient force to block rotational mobility of the detent wheel thereby blocking a rotational actuation of the actuator during the pressure actuation of the actuator.

Further, in carrying out at least one of the above and other objects, the present invention provides an operating element that can be actuated by pressure and rotation. The operating element includes a substrate and a bearing block displaceable relative to the substrate. The operating element further includes an actuator, a detent wheel, and a spring-loaded detent element. The actuator is rotatably mounted on the bearing block by a bearing shaft. The detent wheel is connected to the bearing shaft. The detent wheel has a detent contour. The spring-loaded detent element has a lever with a detent pin. The lever is pivotable at one end about a rotational bearing on the bearing block. The detent pin is biased by a spring away from the substrate and against the detent contour of the detent wheel. The bearing block including the bearing shaft with the actuator and the detent wheel displace toward the substrate during a pressure actuation of the actuator such that the detent pin presses against the detent contour of the detent wheel with sufficient force to block rotational mobility of the detent wheel thereby blocking a rotational actuation of the actuator during the pressure actuation of the actuator and such that a free end of the lever opposite to the rotational bearing is displaced toward the substrate which thereby limits a pivoting range of the lever during the pressure actuation of the actuator.

Also, in carrying out at least one of the above and other objects, the present invention provides an operating element including an actuator, a detent wheel, and a lever. The actuator is rotatably mounted on a displaceable bearing block by a bearing shaft such that the actuator can be rotationally actuated and pressure actuated. The detent wheel is connected to the bearing shaft to rotate with the actuator during a rotational actuation of the actuator and to displace with the actuator during a pressure actuation of the actuator. The detent wheel has a detent contour. The lever is pivotable at one end about a rotational bearing on the bearing block, the lever having a detent pin spring-biased against the detent contour of the detent wheel such that the lever pivots during a rotational actuation of the actuator and such that the lever displaces during a pressure actuation of the actuator. During a pressure actuation of the actuator a free end of the lever opposite to the rotational bearing displaces which thereby limits a pivoting range of the lever and when the pressure actuation of the actuator is with sufficient force the free end of the lever displaces further to engage a fixed object such that the lever is in a fixed position in which the detent pin is pressed against the detent contour of the detent wheel with sufficient force to block rotational mobility of the detent wheel thereby blocking a rotational actuation of the actuator during the pressure actuation of the actuator.

An operating element that can be actuated by pressure and rotation in accordance with embodiments of the present invention includes an actuator connected to a bearing shaft rotatably mounted on a bearing block, a switch that can actuate by a pressure actuation of the actuator, a sensor that can detect a rotational actuation of the actuator, a detent wheel connected to the bearing shaft, and a spring-loaded detent element. The detent element interacts with a detent contour of the detent wheel and blocks the rotational mobility of the detent wheel upon a pressure actuation of the actuator. The detent element includes a detent pin that sits against the detent contour. The detent pin is part of a lever pivotable about a pivot or rotational bearing on the bearing block. A pressure actuation of the actuator causes an end portion of the lever opposite the pivot bearing to become closer to an object or substrate facing the end portion of the lever thereby limiting the pivoting range of the lever.

In an embodiment, the detent element is a lever having a detent pin. The lever is pivotably connected at one end to the bearing block about a rotational bearing. The detent pin is formed in a middle portion of the lever. The detent pin presses against the detent contour of the detent wheel. Pressure actuation of the actuator causes a free end of the lever opposite the end of the lever connected about the rotational bearing to approach an object or substrate of the operating element which thereby limits the pivoting region of the lever.

The detent element in the form of the pivotable lever with the detent pin thereby implements two functions in an advantageous manner. Since the lever forms the detent pin that is spring-loaded to press against the undulating detent contour of the detent wheel, the detent element produces a switching feel by which detent levels or steps can be tangibly detected during a rotational actuation of the actuator.

Pressure actuation of the actuator displaces the bearing block and the lever mounted thereon until the lever arm comes into contact with or at least closely approaches a fixed object, such as the substrate or a housing part of the operating element facing the lever arm. The detent pin hereby lies firmly against the detent wheel and blocks the detent wheel from rotating by tightly penetrating into the detent contour. Thus, the detent pin enables the blocking of the rotation of the actuator during actuation of the pressure function and vice-versa.

It is advantageous when the sensors for the rotational function are located on a separate PCB, which can be flexibly or rigidly designed, and integrated with the actuator into an assembly. The sensors for the rotational function can thereby be largely decoupled mechanically from the sensors of the pressure function. This allows a relatively larger stroke to be implemented for the pressure function.

The above features, and other features and advantages of the present invention are readily apparent from the following detailed description thereof when taken in connection with the accompanying drawings.

DETAILED DESCRIPTION

Figure 1:
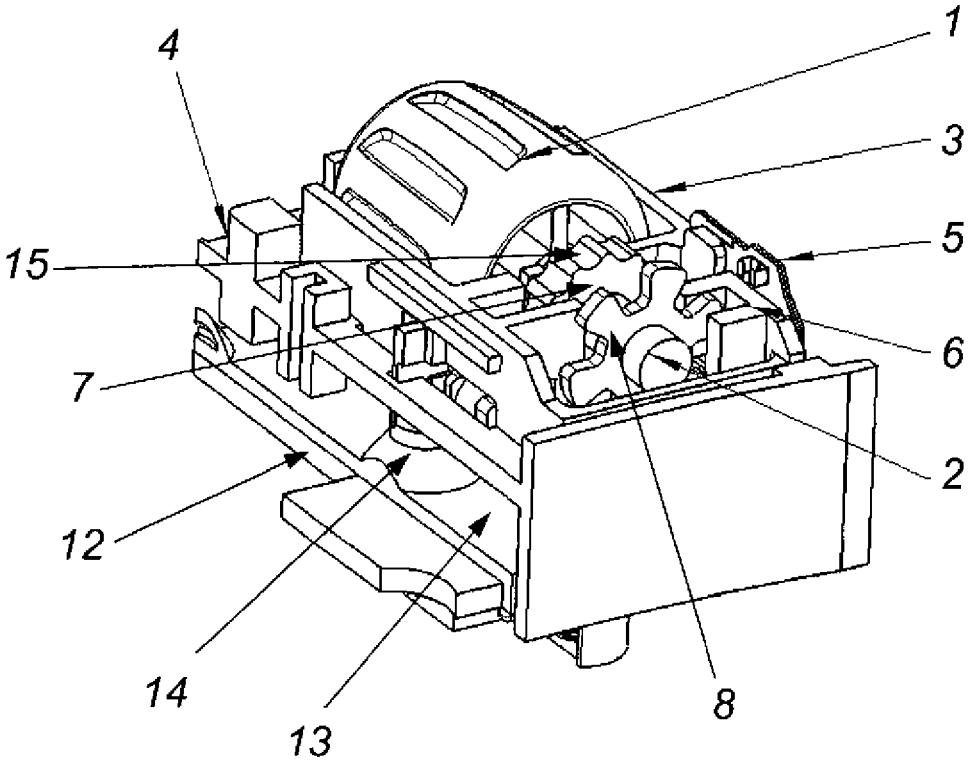
FIG. 1 illustrates an isometric view of an operating element that can be actuated by pressure and rotation in accordance with an embodiment of the present invention.
Figure 2:
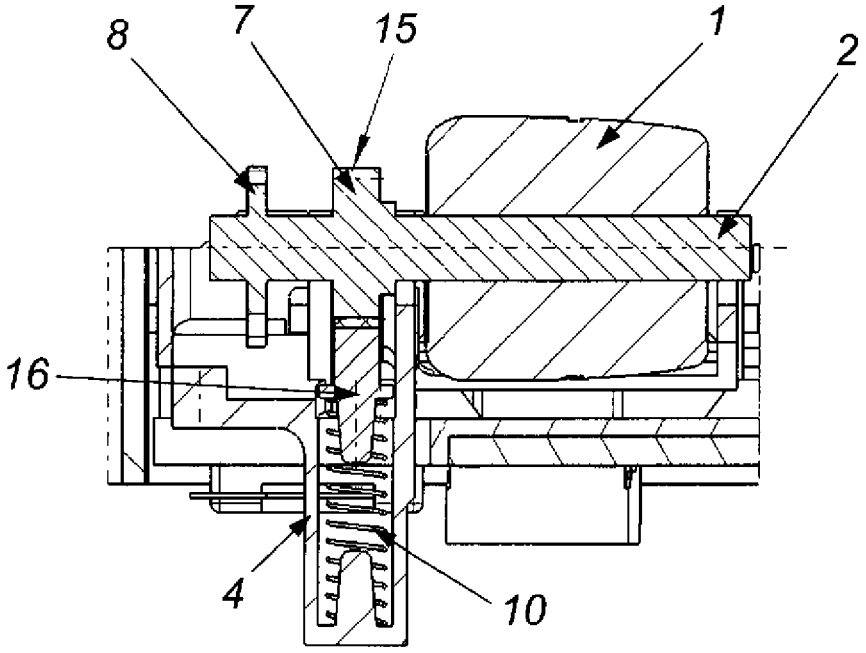
FIG. 2 illustrates a cross-sectional view of the operating element.

Detailed embodiments of the present invention are disclosed herein; however, it is to be understood that the disclosed embodiments are merely exemplary of the present invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Referring now to the Figures, an operating element that can be actuated by pressure and rotation in accordance with an embodiment of the present invention will be described. Operating element 1 includes a cylindrical-shaped actuator 1. Actuator 1 sits on a bearing shaft 2. Bearing shaft 2 is rotatably mounted on a bearing block 3. As such, actuator 1 may be rotationally actuated. Bearing block 3 is inserted linearly into a housing 4. Bearing block 3 is inserted into housing 4 in such a manner that bearing block 4 is displaceable with respect to housing 4. Bearing block 3 displaces in response to a pressure actuation of actuator 1. As such, actuator 1 may also be pressure actuated.

Operating element 1 further includes a dome switch mat 13 having at least one switch dome 14 (e.g., a switch). A substrate 12 having a switch contact (not shown) associated with a respective switch dome 14 is arranged under dome switch mat 13. Bearing block 3 is supported on switch dome 14 and displaces onto switch dome 14 during a pressure actuation of actuator 1. Applying pressure to actuator 1 thereby presses switch dome 14 together and closes or interrupts the switch contact on substrate 12. The pressure actuation is detected by an electronic circuit (not shown). A micro-switch can alternatively be provided as the switch instead of dome switch 14.

Operating element 1 further includes a sensor for detecting rotational motion of actuator 1 during a rotational actuation of actuator 1. As shown as an example, the sensor includes an optical sensor element 6 and a signal transducer 8. Sensor element 6 is electrically connected to a flexible or rigid printed circuit board (PCB) 5. PCB 5 is arranged on bearing block 3 and is an implementation of another substrate of operating element 1. Sensor element 6 is in the form of a forked light barrier and signal transducer 8 is a vane-like rotary encoder mounted on bearing shaft 2. Rotary encoder 8 interacts with sensor element 6 as bearing shaft 2 rotates as actuator 1 rotates to thereby enable the sensor to detect the rotational actuation of actuator 1. The sensor can operate for detecting rotational motion of actuator 1 using a different measurement principle including one in which a magnetic field sensing Hall element detects the rotation of a magnetic disk.

Operating element 1 further includes a detent wheel 7. Detent wheel 7 is connected to bearing shaft 2 between actuator 1 and rotary encoder 8. Detent wheel 7 has an undulating detent curve 15 along its circumference.

Operating element 1 further includes a spring-loaded detent element. The detent element includes a lever 9 having an integrally formed detent pin 16. The detent element further includes a spring 10 which is mounted on housing 4 below detent wheel 7. Spring 10 is configured and biased to continuously press detent pin 16 against detent curve 15 of detent wheel 7.

Figure 3:
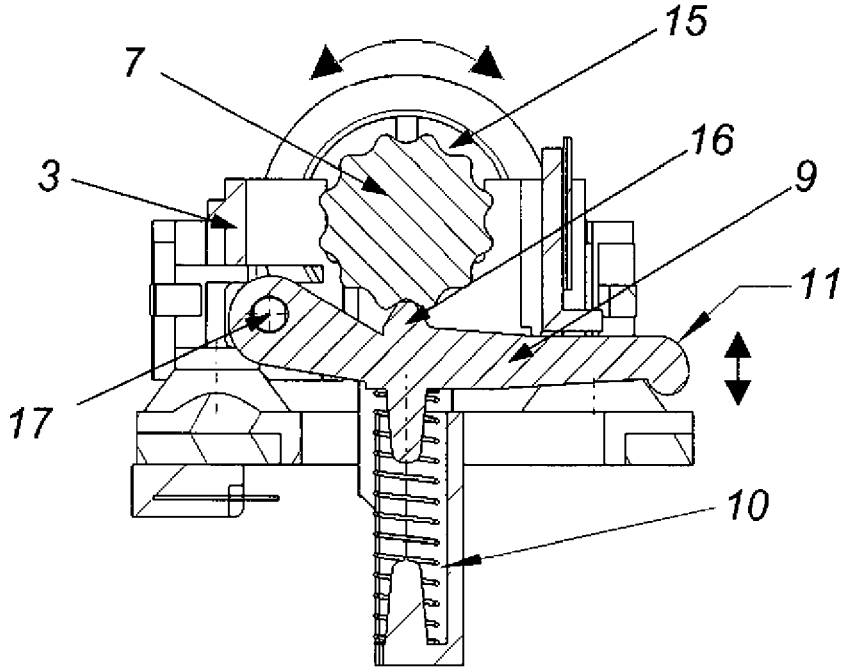
FIG. 3 illustrates a cross-sectional view of the operating element shown through the detent wheel of the operating element during rotational actuation of the operating element.

Lever 9 of the detent element is pivotably mounted with an end section on a rotational bearing 17 on bearing block 3. As such, lever 9 can pivot about rotational bearing 17 relative to bearing block 3. As lever 9 is mounted on just one of its end sections, lever 9 forms a single arm lever in the physical sense. The middle region of lever 9 includes detent pin 16 which is integrally molded thereon approximately perpendicular to the length direction of lever 9. Detent pin 16 is pressed by spring 10 which acts on the bottom side of lever 9 against detent curve 15 of detent wheel 7. End section 11 of lever 9 lying opposite rotational bearing 17 in the position of actuator 1 shown in FIG. 3 is free at the side.

When actuator 1 rotates about bearing shaft 2 in response to a rotational actuation of the operating element, the vertical position of detent pin 16 follows the shape of detent curve 15. Detent pin 16 follows detent curve 15 as detent pin 16 is applied continuously against detent wheel 7 due to the force applied by spring 10 on lever 9. Lever 9 thereby carries out a periodic oscillatory motion around rotational bearing 17. The periodic oscillatory motion around rotational bearing 17 can be detected at free end section 11 of lever 9 as up and down motions based on the relatively small deflections. The amount of effort needed to rotate actuator 1 also varies with the periodic path of detent curve 15, which is experienced haptically as an interrupted rotation.

Figure 4:
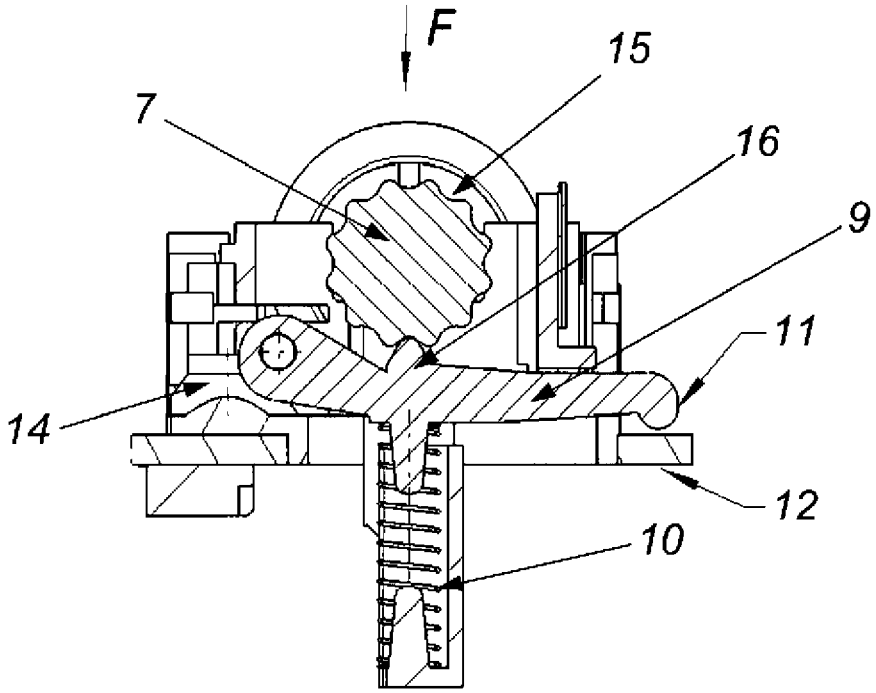
FIGS. 4 and 5 each illustrate a cross-sectional view of the operating element shown through the detent wheel of the operating element during pressure actuation of the operating element.

When a pressure actuation of the operating element occurs, indicated in FIG. 4 by the directional arrow of a force F in the perpendicular direction onto actuator 1, bearing block 3 displaces perpendicular to housing 4 and toward switch dome 14 and substrate 12. This displacement of bearing block 3 causes switch dome 14 to press together and thereby open or close a corresponding switch contact on substrate 12. This generates an electrical signal that can be analyzed.

The displacement of bearing block 3 reduces the distance or interval between free end section 11 of lever 9 and a rigid object facing end section 11. The rigid object is a part of housing 4 or, as shown in FIG. 4, is part of substrate 12. When end section 11 of lever 9 strikes substrate 12 due to bearing block 3 being displaced toward substrate 12 from a pressure actuation onto actuator 1, substrate 12 creates a limit stop for the pressure actuation.

Figure 5:
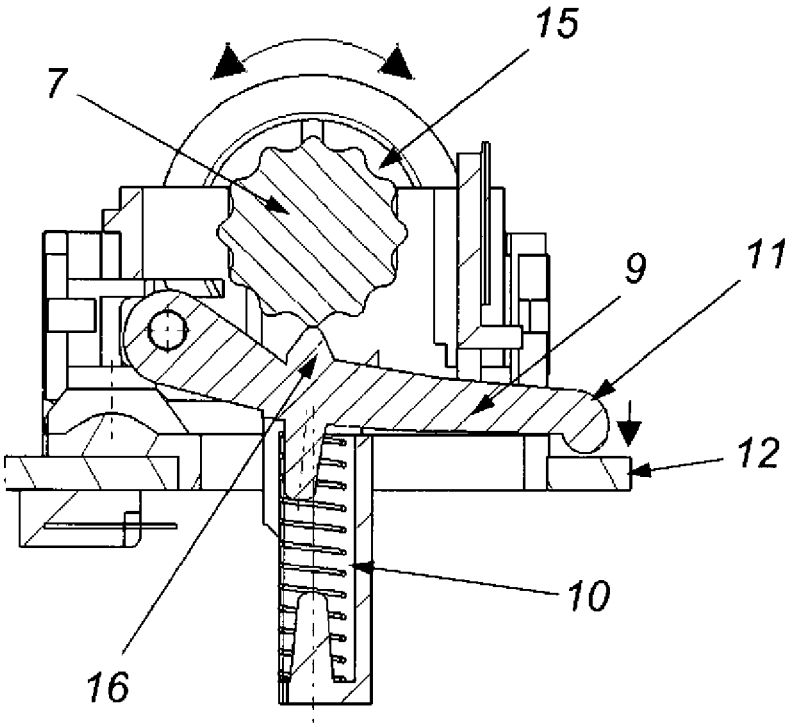

As is shown in FIG. 5, when an attempt is made to rotate pressure-actuated actuator 1 further, the next bump of detent curve 15 moves detent pin 16 further against spring 10. This causes end section 11 of lever 9 to be pressed more strongly against substrate 12. A displacement of detent pin 16 is thus only possible with a significant effort, and is for example not even possible with a sufficiently rigid lever 9, so that the rotational motion of actuator 1 is now greatly restricted or even eliminated. The rotational function is thereby blocked. The release of the rotational function occurs by initially releasing the force applied to actuator 1 and is thus only enabled by ending the actuating pressure.

As described, the present invention provides an operating element that can be actuated both by pressure and rotation in which a simultaneous actuation of both functions is blocked. The operating element according to the present invention can advantageously be used as the steering control element in a motor vehicle.

REFERENCE SYMBOLS

1 actuator
2 bearing shaft
3 bearing block
4 housing
5 printed circuit board
6 sensor
7 detent wheel
8 signal transducer (rotary encoder)
9 lever, latching element
10 spring
11 free end section (section)
12 substrate (object)
13 dome switch mat
14 dome switch (switching element)
15 detent curve
16 detent pin
17 rotational bearing
F force While exemplary embodiments are described above, it is not intended that these embodiments describe all possible forms of the present invention. Rather, the words used in the specification are words of description rather than limitation, and it is understood that various changes may be made without departing from the spirit and scope of the invention. Additionally, the features of various implementing embodiments may be combined to form further embodiments of the present invention.

What is claimed is:

1. An operating element comprising:

an actuator rotatably mounted on a displaceable bearing block by a bearing shaft such that the actuator can be rotationally actuated about a rotation axis and pressure actuated along a displacement axis normal to the rotation axis;

a detent wheel connected to the bearing shaft to rotate along the rotation axis during a rotational actuation of the actuator and to displace along the displacement axis during a pressure actuation of the actuator, the detent wheel having a detent contour; and a spring-loaded detent element having a lever with a detent pin, the lever being pivotable at one end about a rotational bearing on the bearing block, the detent pin being biased, by a spring, along the displacement axis against the detent contour of the detent wheel;

wherein the actuator including the bearing shaft with the detent wheel displace along the displacement axis during a pressure actuation of the actuator such that the lever displaces along the displacement axis to a fixed position in which the detent pin is pressed along the displacement axis against the detent contour of the detent wheel with sufficient force to block rotational mobility of the detent wheel thereby blocking a rotational actuation of the actuator during the pressure actuation of the actuator.

2. The operating element of claim 1 wherein:

in the fixed position of the lever a free end of the lever opposite to the rotational bearing is displaced which thereby limits a pivoting range of the lever during the pressure actuation of the actuator.

3. The operating element of claim 1 further comprising:

a switch;

wherein the bearing block displaces onto the switch during a pressure actuation of the actuator such that the switch actuates by a pressure actuation of the actuator.

4. The operating element of claim 3 wherein:
the switch is a dome switch of a dome switch mat.

5. The operating element of claim 1 further comprising:
a sensor configured to detect a rotational actuation of the actuator.

6. The operating element of claim 1 wherein:
the switch is a micro-switch.

7. The operating element of claim 1 wherein:
the actuator is one of cylindrical-shaped and disk-shaped.

8. The operating element of claim 1 wherein:
the operating element is on a vehicle steering wheel.

9. An operating element that can be actuated by pressure and rotation, the operating element comprising:
a substrate;
a bearing block displaceable relative to the substrate along a displacement axis;
an actuator rotatably mounted on the bearing block by a bearing shaft such that the actuator can be rotationally actuated about a rotation axis normal to the displacement axis;
a detent wheel connected to the bearing shaft to rotate along the rotation axis during a rotational actuation of the actuator and to displace along the displacement axis during a pressure actuation of the actuator, the detent wheel having a detent contour; and
a spring-loaded detent element having a lever with a detent pin, the lever being pivotable at one end about a rotational bearing on the bearing block, the detent pin being biased, by a spring, along the displacement axis away from the substrate and against the detent contour of the detent wheel;
wherein the bearing block including the bearing shaft with the actuator and the detent wheel displace along the displacement axis toward the substrate during a pressure actuation of the actuator such that the detent pin presses along the displacement axis against the detent contour of the detent wheel with sufficient force to block rotational mobility of the detent wheel thereby blocking a rotational actuation of the actuator during the pressure actuation of the actuator and such that a free end of the lever opposite to the rotational bearing is displaced along the displacement axis toward the substrate which thereby limits a pivoting range of the lever during the pressure actuation of the actuator.

10. The operating element of claim 9 further comprising:
a switch;
wherein the bearing block displaces onto the switch during a pressure actuation of the actuator such that the switch actuates by a pressure actuation of the actuator.

11. The operating element of claim 10 wherein:
the switch is a dome switch of a dome switch mat placed on the substrate.

12. The operating element of claim 9 further comprising:
a sensor configured to detect a rotational actuation of the actuator.

13. The operating element of claim 9 wherein:
the switch is a micro-switch.

14. The operating element of claim 9 wherein:
the actuator is one of cylindrical-shaped and disk-shaped.

15. The operating element of claim 9 wherein:
the operating element is on a vehicle steering wheel.

16. An operating element comprising:
an actuator rotatably mounted on a displaceable bearing block by a bearing shaft such that the actuator can be rotationally actuated about a rotation axis and pressure actuated along a displacement axis normal to the rotation axis;
a detent wheel connected to the bearing shaft to rotate with the actuator along the rotation axis during a rotational actuation of the actuator and to displace with the actuator along the displacement axis during a pressure actuation of the actuator, the detent wheel having a detent contour; and
a lever pivotable at one end about a rotational bearing on the bearing block, the lever having a detent pin spring-biased against the detent contour of the detent wheel such that the lever pivots along the displacement axis during a rotational actuation of the actuator and such that the lever displaces along the displacement axis during a pressure actuation of the actuator;
wherein during a pressure actuation of the actuator a free end of the lever opposite to the rotational bearing displaces which thereby limits a pivoting range of the lever and when the pressure actuation of the actuator is with sufficient force the free end of the lever displaces further to engage a fixed object such that the lever is in a fixed position in which the detent pin is pressed along the displacement axis against the detent contour of the detent wheel with sufficient force to block rotational mobility of the detent wheel thereby blocking a rotational actuation of the actuator during the pressure actuation of the actuator.

17. The operating element of claim 16 further comprising:
a switch configured to actuate during a pressure actuation of the actuator.

18. The operating element of claim 16 further comprising:
a sensor configured to detect a rotational actuation of the actuator.

* * * * *